US005149618A

United States Patent [19]

Tappe et al.

[11] Patent Number: 5,149,618

[45] Date of Patent: Sep. 22, 1992

[54] BLEACH FIXING PROCESS

[75] Inventors: Gustav Tappe, Leverkusen; Ralf Wichmann, Cologne; Heinz Meckl, Bergisch Gladbach; Edgar Draber, Cologne, all of Fed. Rep. of Germany

[73] Assignee: Agfa Gevaert Aktiengesellschaft, Leverkusen Bermany, Fed. Rep. of Germany

[21] Appl. No.: 763,115

[22] Filed: Sep. 20, 1991

[30] Foreign Application Priority Data

Oct. 6, 1990 [DE] Fed. Rep. of Germany ..... 4031757

[51] Int. Cl.[5] ..... G03C 7/00

[52] U.S. Cl. ..... 430/393; 430/430; 430/460; 430/461

[58] Field of Search ..... 430/393, 430, 460, 461

[56] References Cited

U.S. PATENT DOCUMENTS 4,774,169 9/1988 Kuse et al. ..... 430/461
4,857,441 8/1989 Abe et al. ..... 430/430
4,914,008 4/1990 Kurematsu et al. ..... 430/430

FOREIGN PATENT DOCUMENTS 0270217 6/1988 European Pat. Off. ..... 430/461
0293729 12/1988 European Pat. Off. ..... 430/461

*Primary Examiner*—Charles L. Bowers, Jr.
*Assistant Examiner*—Thomas R. Neville
*Attorney, Agent, or Firm*—Connolly and Hutz

[57] ABSTRACT

The process for bleach fixing an exposed and developed color photographic material whose silver halide emulsion layers contain silver chlorobromide emulsions having a silver bromide content of from 0.3 to 2.0 mol%, in which the bleach fixing bath (1) contains, as bleaching agent, an iron(III) complex at least 50 mol% of whose complex former corresponds to the following formula

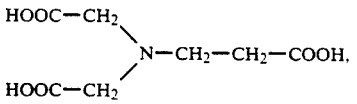

(I)

(2) is adjusted to a pH of x where $7.0 > x > 4.5$ and
(3) contains a thiosulphate is distinguished by a powerful bleaching action and great environmental compatibility.

3 Claims, No Drawings

BLEACH FIXING PROCESS

This invention relates to a particularly environmentally friendly bleach fixing bath suitable for processing colour photographic silver halide materials.

The bleaching agents conventionally used for bleaching and fixing the silver formed on development of colour photographic materials are iron complex salts of amino-polycarboxylic acids, for example, the iron ammonium complex salt of ethylene diaminotetraacetic acid. This and similar complex formers also used are only capable of very slow biological degradation and therefore accumulate in the environment.

When bleach fixing baths containing iron complexes of biologically readily degradable complex formers such as nitrilotriacetic acid are used under the usual conditions at pH 6 to 8 for bleaching and fixing colour photographic materials in which the silver halide emulsions have high chloride contents, the bleaching power is insufficient.

It was an object of the present invention to provide a bleach fixing bath suitable for processing colour photographic silver halide materials containing silver chlorobromide emulsions having a silver bromide content of from 0.3 to 2 mol-%, which bleach fixing baths would contain biologically readily degradable components, have a sufficient bleaching power and would not form solid deposits even when left to stand for a considerable length of time.

This problem is solved by means of a bleach fixing bath which (1) contains an iron (III) complex in which at least 50 mol-%, preferably at least 80 mol-%, of the complex former corresponds to formula I $$(HOOC—CH_2)_2—N—CH_2—CH_2—COOH \qquad \text{(I: ADA).}$$

(2) is adjusted to a pH of x where $7.0>x>4.5$ and (3) contains a thiosulphate.

The remaining, at most 50 mol-% and preferably at most 20 mol-% of complex formers, may be conventional complex formers such as ethylene diaminotetraacetic acid, propylene I5 diaminotetraacetic acid, nitrilotriacetic acid or nitrilo-dipropionic monoacetic acid or mixtures of these compounds. Preferably, the complex former according to the invention alone is used.

Iron complex is used in particular in a quantity of from 0.005 to 1.0 mol/liter.

The thiosulphates used may be, for example, sodium, potassium and ammonium thiosulphate, preferably used in a quantity of from 0.2 to 2 mol/liter.

Preferred bleach fixing baths contain from 0.02 to 0.3 mol/liter of sulphite.

The bleach fixing bath preferably contains an excess of from 1 to 120 mol-%, preferably from 5 to 20 mol-%, based on the iron complex, of free complex former.

It was surprisingly found that the complex former according to the invention corresponding to formula I differs advantageously from other complex formers known to be biologically degradable when it is used as iron(III) complex in bleach fixing baths. Compared with the iron complexes of structurally similar nitrilotriacetic acid (NTA), iminodiacetic acid (IDA) and hydroxyethyl iminodiacetic acid (HEIDA), it has a distinctly greater bleaching power even after prolonged use in a bleach fixing bath.

The bleach fixing bath according to the invention is suitable in particular for colour photographic silver halide recording materials having at least one blue-sensitive, at least one green-sensitive and at least one red-sensitive silver halide emulsion layer on a reflective support (e.g. paper coated with polyethylene on both sides), and, associated with these layers, in the sequence given, at least one yellow coupler, at least one magenta coupler and at least one cyan coupler.

The bleach fixing bath according to the invention is used within conventional photographic processes for colour photographic silver halide materials.

The photographic process may be carried out continuously with constant replenishment of the individual processing baths.

The bleach fixing baths mentioned in the examples were investigated for their bleaching behaviour (residual silver in the processed material).

Determination of residual silver:

Photographic material which was exposed through a step wedge and then processed as described below was investigated with an infra-red silver detector PM 8030 of Photo-Matic, Denmark, for the presence of residual silver in the maximum densities.

EXAMPLE 1 (according to the invention)

A colour photographic recording material was prepared by applying the following layers in the sequence given to a layer support of paper coated with polyethylene on both sides. The quantities given refer to 1 $m^2$. The quantities of silver halide applied are given in terms of the corresponding quantities of $AgNO_3$.

Arrangement of layers

1st Layer (substrate layer):
0.2 g of gelatine
2nd Layer (blue sensitive layer):
Blue sensitive silver halide emulsion (99.5 mol-% of chloride, 0.5 mol-% of bromide, average grain diameter 0.8 μm) of 0.63 g of AgN03 containing
1.38 g of gelatine,
0.95 g of yellow coupler Y and
0.29 g of tricresylphosphate (TCP)
3rd Layer (protective layer)
1.1 g of gelatine,
0.06 g of 2,5-dioctylhydroquinone and
0.06 g of dibutylphthalate (DBP)
4th Layer (green sensitive layer)
green sensitized silver halide emulsion (99.5 mol-% of chloride, 0.5 mol-% of bromide, average grain diameter 0.6 μm) of 0.45 g of $AgNO_3$ containing
1.08 g of gelatine,
0.41 g of magenta coupler M,
0.08 g of 2,5-dioctylhydroquinone,
0.34 g of DBP and
0.04 g of TCP
5th Layer (UV protective layer)
15 g of gelatine,
0.6 g of UV absorbent corresponding to the following formula

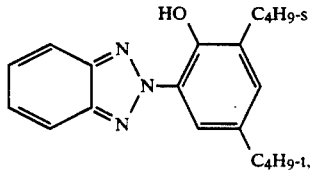

0.045 g of 2,5-dioctylhydroquinone and 0.04 g of TCP
6th Layer (red sensitive layer)
red sensitized silver halide emulsion (99.5 mol-% chloride, 0.5 mol-% bromide, average grain diameter 0.5 μm) of 0.3 g of $AgNO_3$ containing
0.75 g of gelatine,
0.36 g of cyan coupler C and
0.36 g of TCP
7th Layer (UV protective layer)
0.35 g of gelatine,
0.15 g of the UV absorbent of the 5th Layer and
0.2 g of TCP
8th Layer (protective layer)
0.9 g of gelatine and
0.3 g of hardener H corresponding to the following

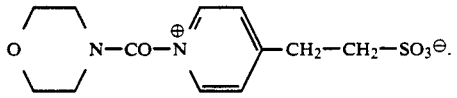

The components used to the following formulae:

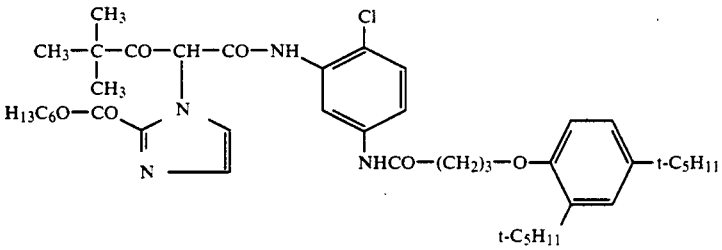

Y

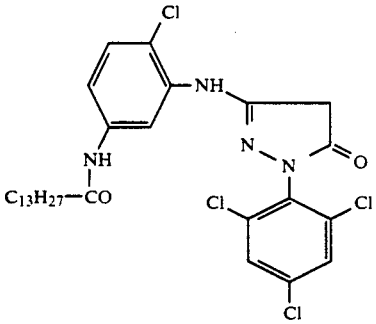

M

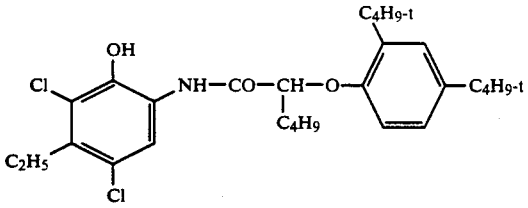

C

The photographic recording material described above was exposed through a step wedge and processed as follows:

| | | |
|---|---|---|
| Development | 45 s | 35° C. |
| Bleach fixing | 45 s | 35° C. |
| Washing | 90 s | about 30° C. |
| Drying. | | |

Washing is carried out in 4 cascade stages of 22.5 s each.

The individual processing baths had the following compositions:

| Developer: | |
|---|---|
| Water | 900 ml |
| Ethylene diaminotetraacetic acid (EDTA) | 2 g |
| Hydroxyethane diphosphonic acid (HEDP) 60% by wt. | 0.5 ml |
| Sodium chloride | 2 g |
| N,N-Diethylhydroxylamine, 85% by wt. | 5 ml |
| 4-(N-Ethyl-N-2-methanesulphonylaminoethyl)-2-methyl phenylene diaminosesquisulphate monohydrate (CD3), 50% by wt. | 8 ml |
| Potassium carbonate | 25 g |

pH adjustment to 10 with KOH or $H_2SO_4$ Made up with water to 1 liter.

| Bleach fixing bath | |
|---|---|
| Water | 800 ml |
| Iron complex | see Table 1 |
| Free complex former | see Table 1 |
| Ammonium thiosulphate | 80 g |
| Sodium disulphite | 10 g |

made up with water to 1 liter, pH adjusted to 6.0 with ammonia.

TABLE 1

| Iron complexes | |
|---|---|
| Fe-NTA | 36.2 g/l |
| Fe-IDA | 27.6 g/l |
| Fe-HEIDA | 34.2 g/l |
| Fe-ADA | 38.3 g/l |

free complex formers: 10% by weight of the quantity of iron complex in each case The material described was processed in bleach fixing baths with the iron complexes mentioned in Table 1. The residual silver values found are shown in Table 2.

TABLE 2

| Iron complexes of | Silver detector values |
|---|---|
| Nitrilotriacetic acid (NTA) | 8.0 |
| Iminodiacetic acid (IDA) | 5.5 |
| Hydroxyethyliminodiacetic acid (HEIDA) | 7.0 |
| Nitrilomonopropionic diacetic acid (ADA) | 3.5 |

The Table shows that the detector value for freedom from silver, which should be ≦4.0, is only achieved with the iron complex of nitrilomonopropionic diacetic acid.

EXAMPLE 2

The material mentioned in Example 1 was processed by the process described there except that instead of being washed in water, it was treated in a stabilizing bath. Stabilization was carried out in 4 cascade stages of 22.5 s each at 35° C.

| Stabilizing bath | |
|---|---|
| Water | 900 ml |
| Sodium disulphite | 2 g |
| Disodium salt of hydroxyethane diphosphonic acid | 4 g |
| Sodium benzoate | 0.5 g |

made up with water to 1 liter, pH 5.0.

The same quantities of residual silver were found.

We claim:

1. A process for bleach fixing an exposed and developed colour photographic material whose silver halide emulsion layers contain silver chlorobromide emulsions having a silver bromide content of from 0.3 to 2.0 mol-%, characterised in that the bleach fixing bath (1) contains, as bleaching agent, an iron (III) complex, at least 50 mol-% of whose complex former corresponds to the following formula

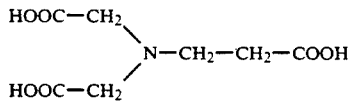

(I)

(2) is adjusted to a pH of x, where 7.0>x>4.5 and (3) contains a thiosulphate.

2. A process according to claim 1, characterised in that at least 80 mol-% of the complex former corresponds to the formula I.

3. A process according to claim 1, characterised in that the bleach fixing baths contains an excess of free complex former of from 1 to 120 mol-%.

* * * * *